US006846386B2

(12) United States Patent
Erikson et al.

(10) Patent No.: US 6,846,386 B2
(45) Date of Patent: Jan. 25, 2005

(54) METHOD OF ENSURING FLATNESS OF A VANE IN A HEADBOX BY MEANS OF A MOUNTING ARRANGEMENT, HEADBOX WITH SUCH A MOUNTING ARRANGEMENT, A MOUNTING ARRANGEMENT AND VANE THEREFOR

(75) Inventors: Jan Anders Erikson, Karlstad (SE); Tord Gustav Gustavsson, Forshaga (SE); Ingvar Berndt Erik Klerelid, Karlstad (SE); Joakim Norrman, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 10/325,641

(22) Filed: Dec. 20, 2002

(65) Prior Publication Data

US 2003/0131964 A1 Jul. 17, 2003

Related U.S. Application Data

(63) Continuation of application No. PCT/SE01/01368, filed on Jun. 18, 2001.

(30) Foreign Application Priority Data

Jun. 22, 2000 (SE) ..... 0002338

(51) Int. Cl.[7] ..... D21F 1/06

(52) U.S. Cl. ..... 162/343; 162/344; 162/336

(58) Field of Search ..... 162/343, 344, 162/336

(56) References Cited

U.S. PATENT DOCUMENTS 6,165,324 A * 12/2000 Linden ..... 162/343

* cited by examiner

*Primary Examiner*—Peter Chin
*Assistant Examiner*—Mark Halpern
(74) *Attorney, Agent, or Firm*—Alston & Bird LLP

(57) ABSTRACT

A method of ensuring the flatness of a vane that is mounted in a headbox by means of a mounting arrangement including engagement dowels for cooperation with a downstream support wall of a transverse groove, said vane being affected during operation by shearing forces from the stock and by retaining forces from the mounting arrangement. In accordance with the invention outer engagement dowels are mounted at the side edges of the vane to cooperate during a specific period of time, as the only engagement dowels with the downstream support wall in order to take up said shearing forces, whereby tensile stresses will arise in the downstream end portion of the vane in the cross machine direction. The invention also relates to a headbox having such a mounting arrangement and the mounting arrangement per se in which the vane within and downstream of an inner area of the upstream end portion of the vane is arranged to move freely in the machine direction in relation to said downstream support wall during said period of time.

20 Claims, 8 Drawing Sheets

METHOD OF ENSURING FLATNESS OF A VANE IN A HEADBOX BY MEANS OF A MOUNTING ARRANGEMENT, HEADBOX WITH SUCH A MOUNTING ARRANGEMENT, A MOUNTING ARRANGEMENT AND VANE THEREFOR

CROSS-REFERENCE TO RELATED APPLICATIONS

This application is a continuation of International Patent Application PCT/SE01/01368 filed Jun. 18, 2001, which designated *inter alia* the United States and was published under PCT Article 21(2) in English, and which claims the benefit of U.S. Provisional Patent Application No. 60/221,072, filed Jul. 27, 2000.

FIELD OF THE INVENTION

The present invention relates to a method of ensuring the flatness of a vane that is detachably mounted in a headbox by means of a mounting arrangement that includes a plurality of engagement members that are connected to the vane at its upstream end portion, and a longitudinal groove for receiving the engagement members of the vane, the groove having inner, downstream and upstream support walls that face towards the engagement members for cooperation therewith, the vane being affected during operation by shearing forces caused by stock flowing along the vane, and by retaining forces exerted on the vane by the mounting arrangement.

The invention also relates to a headbox for delivering a jet of stock to a forming zone in a former for wet forming of a fiber web, including

- a slice having a chamber,
- a turbulence generator including
  - turbulence channels opening into the slice chamber, and
  - at least one anchoring element that separates the turbulence channels,
- at least one vane arranged in the slice chamber,
- and an arrangement for detachable mounting of the vane to the anchoring element, the mounting arrangement including
  - a plurality of engagement members that are connected to the vane at its upstream end portion, and
  - an elongate structural element having a longitudinal groove for receiving the engagement members of the vane, the groove having inner, parallel downstream and upstream support walls that face towards the engagement members for cooperation therewith.

The invention also relates to an arrangement for detachably mounting a vane to an anchoring element of a turbulence generator of a headbox for delivering a jet of stock to a forming zone in a former for wet forming a fiber web, including

- a slice having a chamber,
- the turbulence generator including
  - turbulence channels opening into the slice chamber, and
  - the anchoring element that separates the turbulence channels,
- at least one vane arranged in the slice chamber, the mounting arrangement including
  - a plurality of engagement members that are connected to the vane at its upstream end portion, and
  - an elongate structural element having a longitudinal groove for receiving the engagement members of the vane, the groove having inner, parallel, downstream and upstream support walls that face towards the engagement members for cooperation therewith.

BACKGROUND OF THE INVENTION

A known headbox of the type described above has engagement members in the form of oblong engagement bodies or engagement dowels arranged in a row extending in the cross machine direction at the upstream end portion of the vane. The engagement dowels have portions protruding from the vane to cooperate with the support walls of the connection bar. The vane is influenced during operation both by a shearing force in the machine direction caused by stock flowing along the vane, as well as a retaining force directed against the machine direction exerted on the engagement dowels by the support wall situated downstream. It is intended that the retaining force during operation be distributed uniformly among the engagement dowels. In practice, however, the retaining force may be distributed non-uniformly among the engagement dowels so that the shearing force on the vane gives rise to local compressive stresses in the cross machine direction in the downstream end portion of the vane. Where compressive stresses arise the vane can buckle, making its downstream end portion uneven, which is not desirable, particularly at a separating vane that separates two layers of stock, since good layering of stock is dependent on a flat separating vane. If the separating vane is not flat, streaks having a grammage different from the rest of the paper web may appear, for instance.

The above-mentioned compressive stresses may arise as a result of variations in the placing of the engagement dowels within a predetermined tolerance interval. The placing of the engagement dowels within the tolerance interval may, for instance, deviate from an ideal placing in such a way that certain engagement dowels are downstream of the other engagement dowels, in which case the retaining force will be distributed in an uncontrolled manner between the engagement dowels, with the risk of compressive stresses appearing in the downstream end portion of the vane, resulting in buckling.

Compressive stresses may also appear in a vane consisting of a plastic material, e.g., glass fiber-reinforced epoxy resin, and having reduced thickness in the machine direction so that the downstream end portion of the vane is relatively thin in relation to the upstream end portion. A vane of plastic material absorbs water from the surroundings both during storage prior to mounting, and also after mounting in the headbox when the vane absorbs liquid from the stocks. As a result of the differences in thickness, the thinner downstream end portion of the vane will become saturated earlier than the thicker upstream end portion of the vane. As the downstream end portion becomes saturated in the direction away from the downstream edge, the downstream end portion lengthens in the cross machine direction, whereas the thicker, unsaturated upstream end portion of the vane retains its dimensions. The extension of the vane at the downstream edge results in the downstream edge of the vane endeavouring to assume a convex form and its upstream edge a concave form. When such a partially saturated vane is influenced during operation by the shearing force from the stocks, the retaining force will be distributed non-uniformly between the engagement dowels so that the downstream end portion of the vane becomes buckled.

SUMMARY OF THE INVENTION

The object of the present invention is to essentially reduce the problems mentioned above and to provide a method that will efficiently ensure the flatness of a vane.

It is also an object of the invention to provide a mounting arrangement and a headbox with such a mounting arrangement for each of the vanes that is designed so as to ensure flatness of the vane during operation.

The method in accordance with the invention comprises the steps of mounting at least one outer engagement member in the proximity of each side edge of the vane such that an inner area of the upstream end portion of the vane is defined between the outer engagement members, and causing the outer engagement members to cooperate during operation for at least one specific period of time as the only engagement members with the downstream support wall to take up the shearing forces, whereby tensile stresses arise in a downstream end portion of the vane in the cross machine direction. The tensile stresses ensure the flatness of the downstream end portion of the vane.

The headbox and the mounting arrangement in accordance with the invention are characterized in that the plurality of engagement members include at least one outer engagement member in the proximity of each side edge of the vane, the two outer engagement members being arranged during operation for at least one specific period of time as the only engagement members that cooperate with the downstream support wall to take up the shearing forces generated in the vane by the flowing stocks. An inner area of the upstream end portion defined between the outer engagement members is free from engagement members or has inner engagement members that at least in the unloaded state of the vane are located upstream of the downstream support wall so that the vane within and downstream of the inner area is arranged to be able to move freely in the machine direction in relation to the downstream support wall during the period of time or part thereof.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
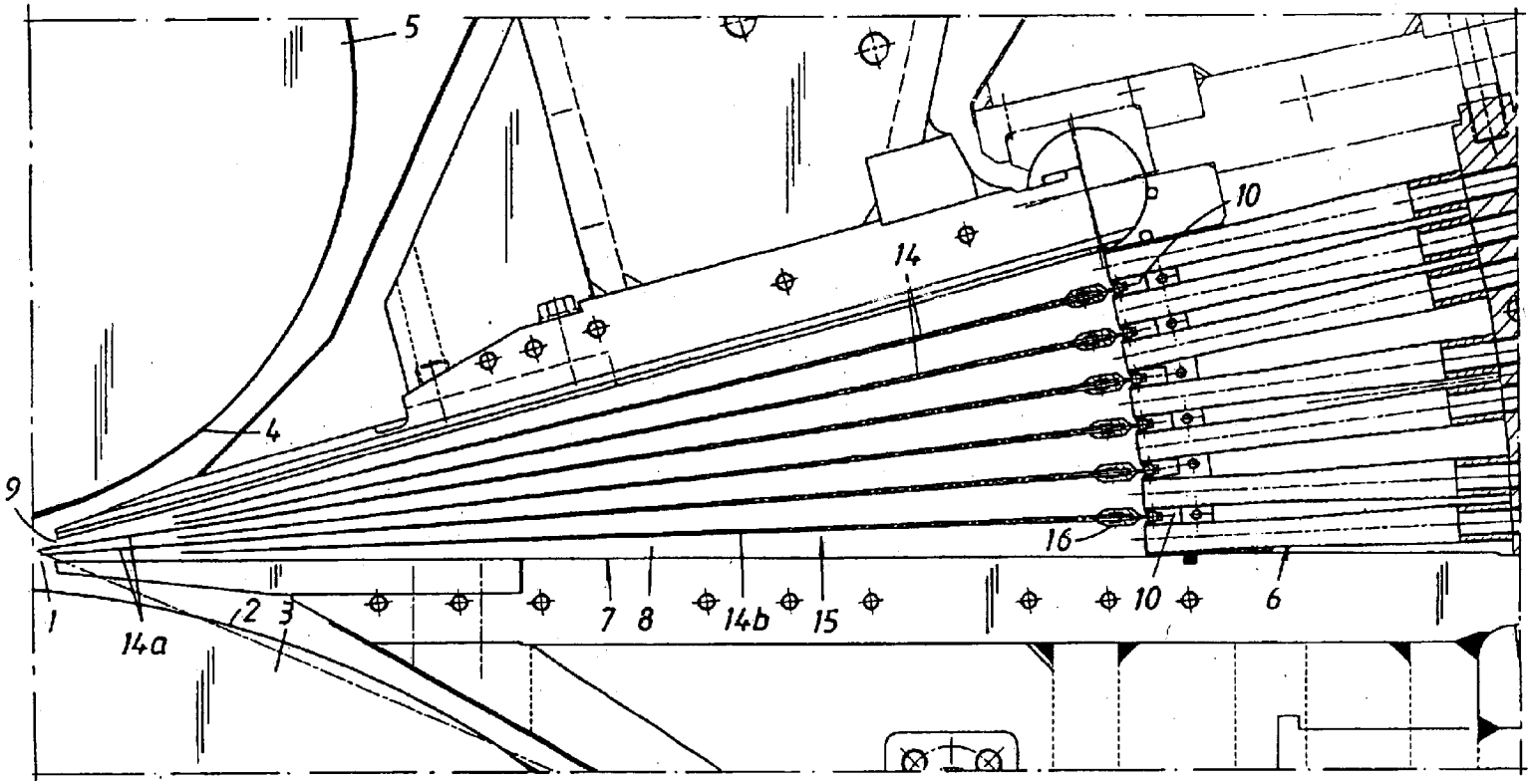
FIG. 1 is a sectional view in the machine direction of a part of a multilayer headbox mounted to deliver a multilayer jet of stock into a gap leading to a forming zone in a twin wire former of roll type.

FIG. 1 schematically shows a headbox designed to deliver a three-layer jet of stock into a gap 1 leading to a forming zone in a twin wire former of roll type. The twin wire former has an inner forming wire 2, a rotatable forming roll 3, an outer forming wire 4 and a rotatable breast roll 5.

The headbox has a turbulence generator including a group of turbulence channels 6 and a slice 7 arranged downstream of the turbulence channels 6 and containing a chamber 8 that converges from its upstream end in the direction of the flow of stock and terminates in a slice opening 9 at its downstream end.

The turbulence channels 6 are arranged in three sections for supplying three different stocks, for instance, into the slice chamber 8. The lower section and the middle section each have two rows of turbulence channels 6 arranged close together, while the upper section has three such rows of turbulence channels 6. The rows of turbulence channels 6 extend in the cross machine direction and adjacent rows of turbulence channels 6 are separated by elongate stable anchoring elements 10 extending in the cross machine direction. The anchoring element 10 has an elongate, through engagement groove 11 (see FIG. 2), with a side opening 12 facing the slice chamber 8. The group of turbulence channels 6 is connected at its upstream end to a feeding system (not shown) comprising three stores of stock and suitable flow spreaders for uniform distribution of each stock to the rows of turbulence channels 6 in the associated section and uniform distribution of the stock within each row of turbulence channels 6.

In the embodiment shown the headbox has six vanes 14 that divide the slice chamber 8 into seven converging channels 15 communicating with the rows of turbulence channels 6. Two of the vanes 14 constitute stock-separating vanes 14*a* that are arranged to separate the three stocks from each other and extend through the slice opening 9*a* predetermined distance to form a jet that thus consists of three layers. The stock-separating vanes 14*a* also have turbulence-generating function. The other vanes are only turbulence vanes 14*b* having their free ends situated inside the slice chamber at a predetermined distance from the slice opening 9. The vanes 14 are relatively rigid and may consist of a metal material, usually titanium, or a plastic material, usually glass fiber-reinforced or carbon fiber-reinforced epoxy resin. The vanes 14 are sufficiently stiff to support various pressures and velocities of the flows of stock. Each vane 14 is arranged to be detachably mounted to the anchoring element 10 by means of an mounting arrangement comprising an elongate structural element 16 and engagement members 22 arranged in the upstream end portion 21 of the vane 14. In the embodiment shown the structural element 16 comprises a connection bar and the engagement members 22 comprise cylindrical engagement dowels (see FIG. 2) disposed at right angles to the plane of the vane 14. The connection bar 16, consisting of metal, e.g., bronze, is the same length as the width of the vane 14 and includes in the following order an engagement part 17 situated downstream, a flexible waist part 18, and an engagement part 19 situated upstream and forming a pivot. The engagement part 17 is provided with an elongate, through groove 20 to receive the upstream end portion 21 of the vane 14 and its engagement dowels 22 to secure the vane 14 and connection bar 16 to each other, seen in the machine direction. The groove 20 is provided with inner, opposing recesses 23, 24 with support walls 25 and 26, situated downstream and upstream, respectively, which are at right angles to the plane of the vane 14. The engagement part 19, which has a substantially circular cross section, is received in the engagement groove 11 of the anchoring element 10 to pivotally secure the connection bar 16 in the machine direction.

Each engagement dowel 22 has opposing free end portions 27, 28 protruding from the flat sides of the vane 14. The length of the engagement dowel 22 is somewhat less than the distance between the bottom surfaces of the inner recesses 23, 24. The diameter of the engagement dowel 22 is somewhat less than the width of the recesses 23, 24.

Figure 2:
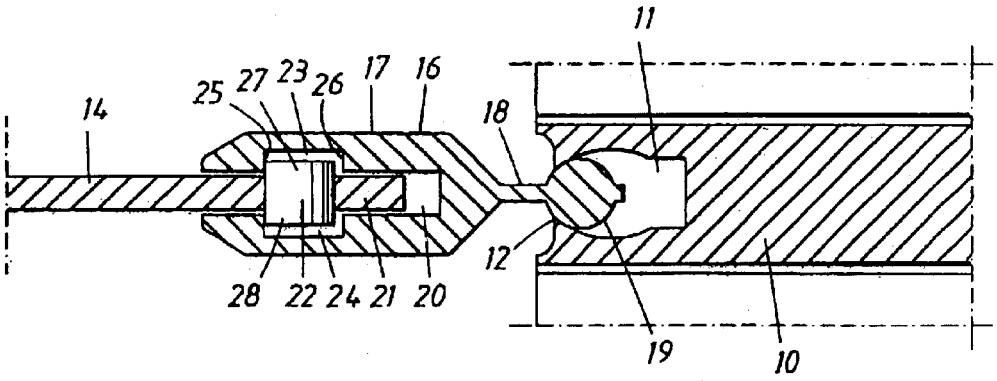
FIG. 2 is a sectional view of an arrangement for mounting one of the vanes in the slice chamber of the headbox in connection with a group of turbulence channels in the headbox according to FIG. 1.
Figure 3:
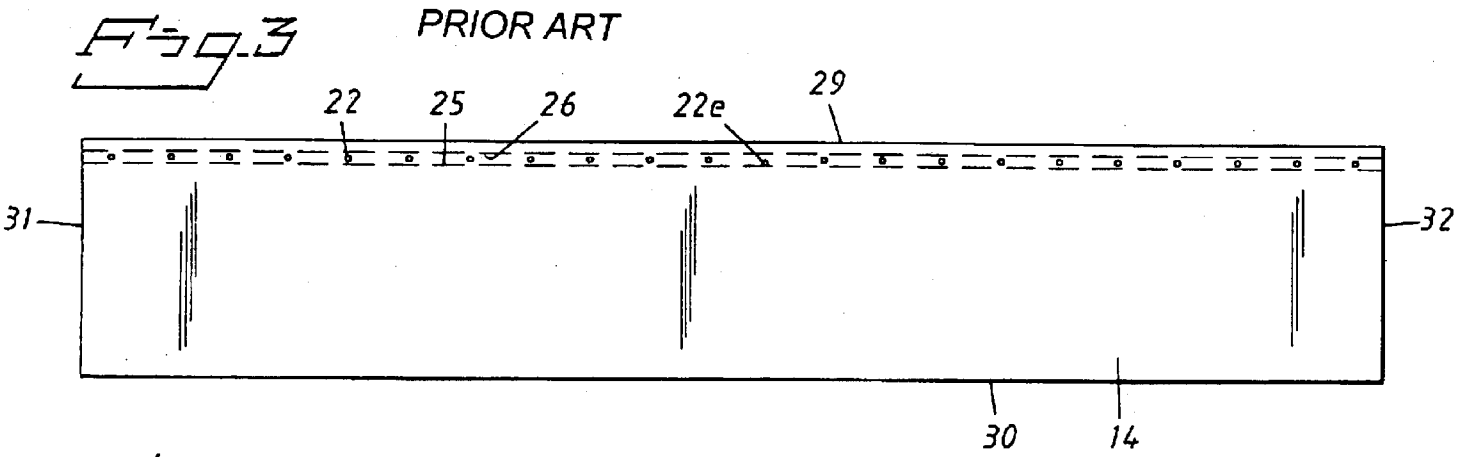
PRIOR ART FIG. 3
FIG. 3 is a view from above of an unloaded vane of metal, and shows parts of a conventional mounting arrangement.
Figure 4:
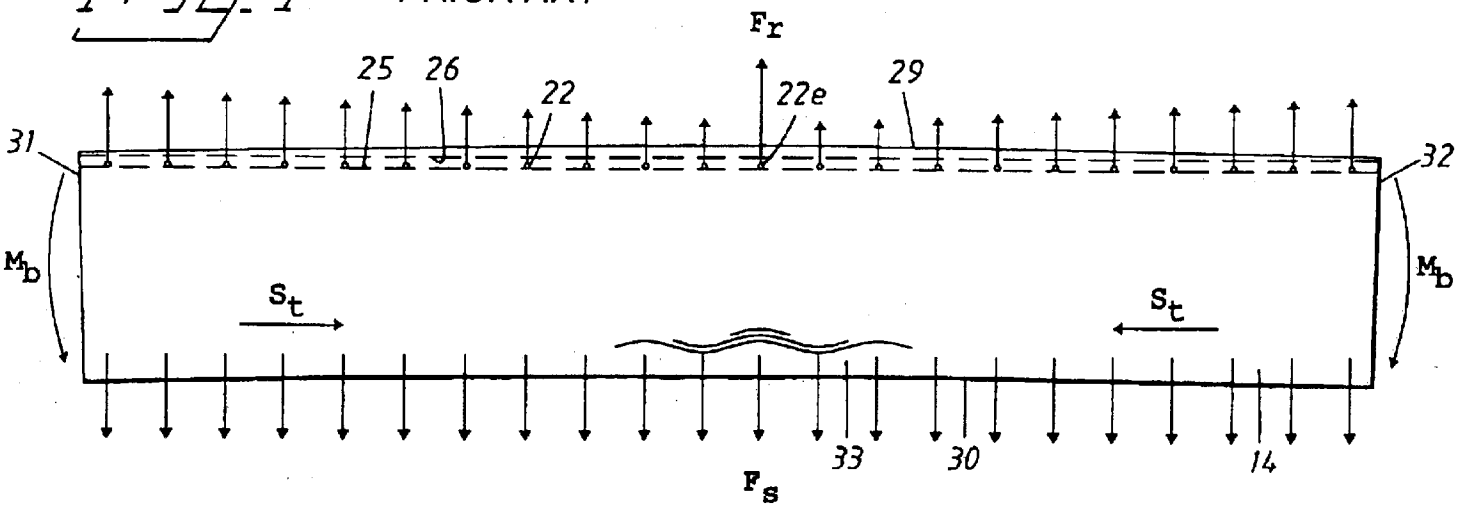
PRIOR ART FIG. 4
FIG. 4 is a view from above of a vane in accordance with FIG. 3 during operation.

To illustrate the principle of how compressive stresses and the buckling associated therewith can arise, reference is made to FIGS. 3–6 showing schematically one of the vanes 14 described above with respect to the attachment arrangement according to conventional technique. The vane 14 has an upstream edge 29, a downstream edge 30 parallel therewith, and two parallel side edges 31, 32 parallel with each other that extend between the upstream and downstream edges. The support walls 25, 26 shown in FIG. 2 are illustrated in FIGS. 3–4 by two parallel, broken lines. The engagement dowels 22 are placed with mutually identical distance from each other in a row as straight as possible within a predetermined first tolerance interval in relation to a line running parallel to and at a predetermined distance from the upstream edge 29 of the vane 14. The support wall 25 situated downstream is made as straight as possible from end to end within a predetermined second tolerance interval. As a result of one or both of the tolerance intervals the positions of the engagement dowels 22 in relation to the downstream support wall 25 may vary. This is illustrated in FIG. 3 in which the engagement dowel 22*e* is situated downstream, i.e., closer to the downstream support wall 25 than the other engagement dowels 22. FIG. 4 shows the vane 14, made of metal, during operation where shearing forces caused by the stocks flowing along the vane 14 press the engagement dowels 22 towards the downstream support wall 25. The shearing forces act along the surfaces of the vane 14 and are illustrated in FIG. 4 by downwardly directed force arrows designated $F_s$. The retaining forces exerted by the downstream support wall 25 on the engagement dowels 22 are illustrated by upwardly directed force arrows designated $F_r$. Since, as can be seen in FIG. 4, the initial position of the engagement dowel 22*e* is downstream of the other engagement dowels 22, the retaining force $F_r$ acting on the engagement dowel 22*e* is greater than the retaining forces $F_r$ acting on the adjacent engagement dowels 22. As a result of the loading that then arises, the vane 14 is subjected to a bending moment in machine direction, which is illustrated in FIG. 4 by moment arrows denoted $M_b$ at both side edges 31, 32 of the vane 14. The bending moment causes compressive stresses in the downstream end portion 33 of the vane 14, in the cross machine direction, illustrated in FIG. 4 by tension arrows designated $S_t$. The compressive stresses $S_t$ buckle the vane 14, as illustrated in FIG. 4 by the wave-shaped lines in the downstream end portion 33.

Figure 5:
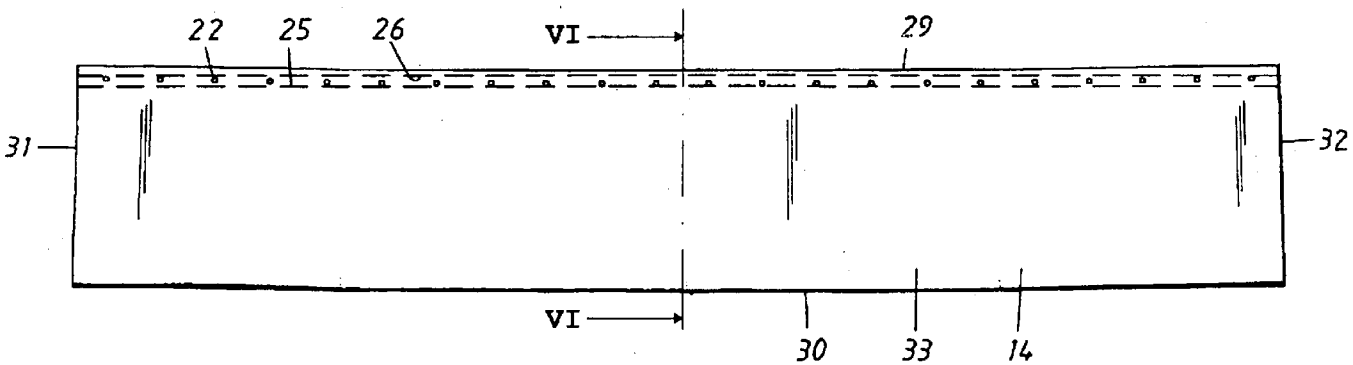
FIG. 5 PRIOR ART
FIG. 5 is a view from above of a vane of moisture-absorbing plastic material and shows parts of a conventional mounting arrangement.
Figure 6:
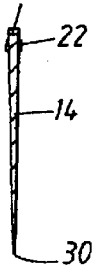
FIG. 6 PRIOR ART
FIG. 6 is a sectional view along the line VI—VI in FIG. 5.

As mentioned earlier, buckling may arise in a vane made of a moisture-absorbing plastic material and having narrowing thickness in the machine direction, as a result of the thinner, downstream end portion of the vane becoming saturated earlier than the thicker upstream end portion of the vane. Such a vane 14 is described in the following with reference to FIGS. 5 and 6 where the vane 14 is shown in unloaded state after, for instance, a certain operating period when it has been in contact with the flowing stocks. As the downstream end portion 33 of the vane 14 becomes saturated in the direction away from the downstream edge 30, the downstream end portion 33 becomes stretched in the cross machine direction, while the thicker, unsaturated upstream end portion 21 of the vane 14 retains its dimensions. For that reason tensions arise in the vane 14 causing the vane to bend in its plane so that the downstream edge 30 of the vane endeavours to assume a convex form and its upstream edge 29 a concave form, as shown in FIG. 5. During operation the load distribution between the engagement dowels 22 becomes non-uniform since the intermediate engagement dowels 22 take up a larger part of the retaining force than the engagement dowels 22 situated closer to the side edges 31, 32 of the vane 14, in the same way as for the vane shown in FIG. 4. In this case the resultant loading also leads to a bending moment in the machine direction, compressive stresses in the cross machine direction in the downstream end part 33 of the vane 14 and buckling of the downstream end portion 33 of the vane 14. As will be understood, the tolerance-dependent buckling described in connection with FIGS. 3 and 4 also can arise in such a vane made of plastic material and therefore reinforce the buckling caused by swelling.

Figure 7:
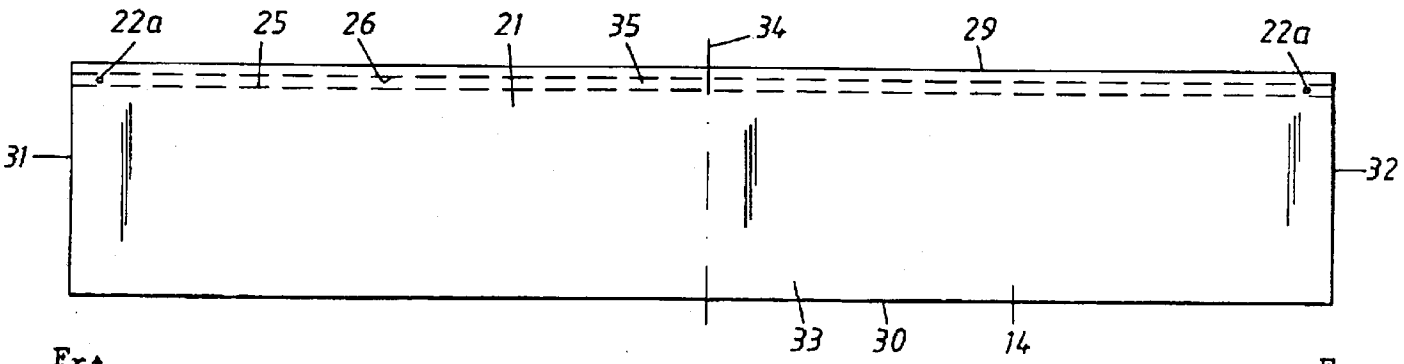
FIG. 7 is a view from above of an unloaded vane, and shows parts of a mounting arrangement in accordance with a first embodiment of the invention.
Figure 8:
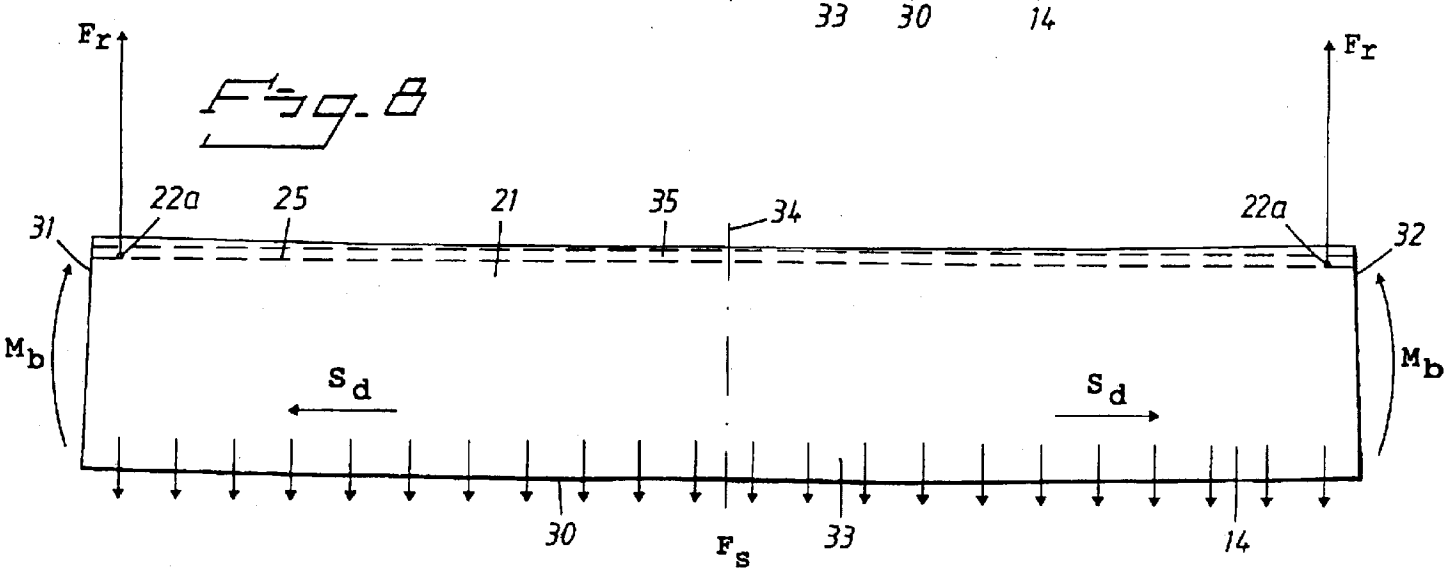
FIG. 8 is a view from above of the vane in accordance with FIG. 7 during operation.

FIG. 7 shows an unloaded vane 14 with parts of a mounting arrangement in accordance with a first embodiment of the invention. FIG. 8 shows the same vane 14 during operation. The vane 14 is symmetrical with respect to its center line 34, which coincides with the machine direction. An outer engagement dowel 22*a* is arranged in the proximity of each side edge 31, 32 of the vane 14, for cooperation with the downstream support wall 25 during operation in order to take up the shearing forces $F_s$ caused by the flowing stocks that load the vane 14. An inner area or central part 35 of the upstream end portion 21 of the vane 14, which extends between the two outer engagement dowels 22*a*, is free from engagement dowels so that the inner area 35 of the vane 14 is arranged to be able to move freely in the machine direction in relation to the support wall 25, as is the upper part of the vane situated downstream of the inner area 35. The displacement may be caused by a change in the velocity of the stock flow or, if the vane 14 consists of a plastic material and has narrowing thickness in the machine direction, by altered tension conditions in the vane 14 as a result of swelling. The retaining forces $F_r$ and the shearing forces $F_s$ together create a bending moment $M_b$ that bends the vane 14 in its plane, stretches the downstream edge 30 of the vane 14 and generates tensile stresses in the cross machine direction in the downstream end portion 33 of the vane 14. These tensile stresses are illustrated in FIG. 8 by stress arrows denoted $S_d$. The displacement may arise during a first period of time that, for a metal vane, is calculated from the moment when the headbox starts to the moment when a specific machine speed has been reached. If the machine speed shall subsequently be increased a second period of time commences, extending between the first and second machine speeds. When the vane consists of a plastic material, a first period of time will extend from the moment when the flows of stock start flowing through the headbox up to the moment when the swelling of the vane is complete, whereupon the same or altered machine speeds can be used during this period of time. After swelling is complete a second period of time can be started extending up to the moment when a desired higher machine speed has been reached. Since there are no engagement dowels in the central area 35, the central area 35 of the vane can move freely forwards without other restrictions than the strength of the vane at the attachment locations for the outer engagement dowels 22*a* and the position of the downstream edge 30 that must not be such that the stock layering is affected unfavorably. In such an embodiment no compressive stresses can arise in the downstream end portion 33 of the vane.

Figure 9:
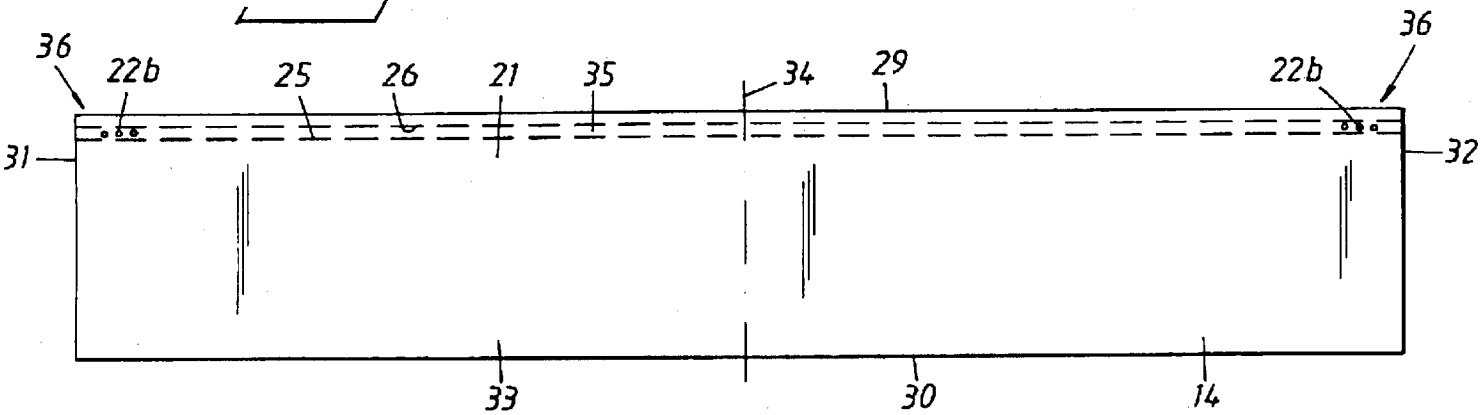
FIG. 9 is a view from above of an unloaded vane and shows parts of a mounting arrangement in accordance with a second embodiment of the invention.
Figure 10:
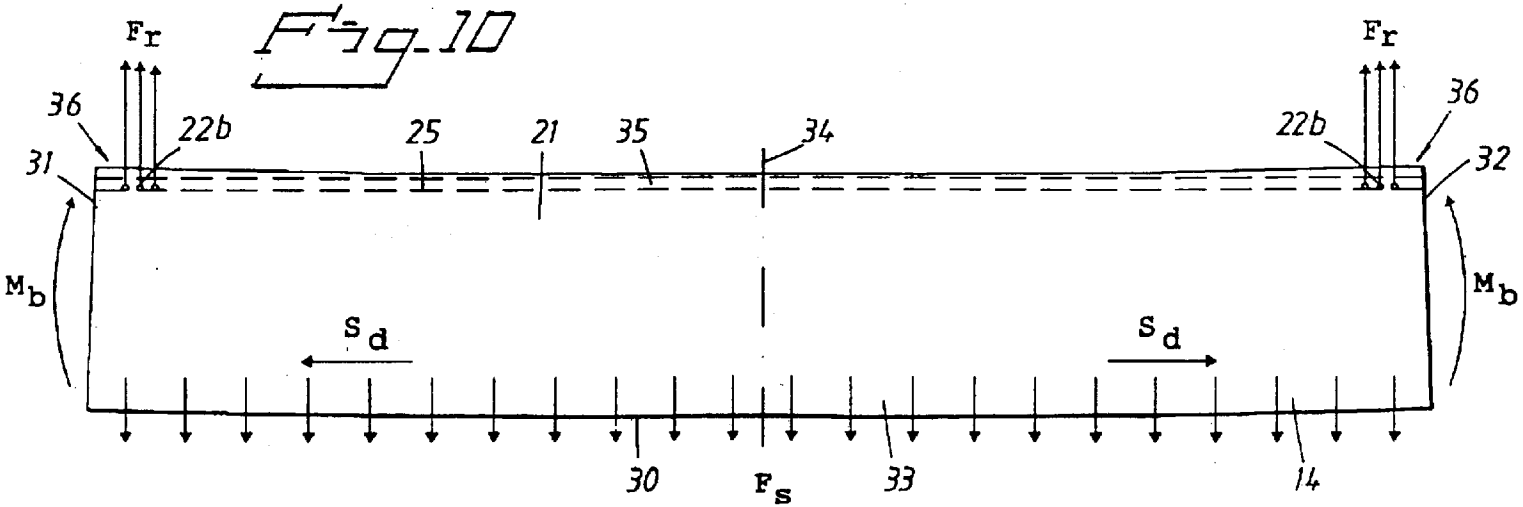
FIG. 10 is a view from above of the vane in accordance with FIG. 9 during operation.

FIG. 9 shows an unloaded vane 14 with parts of a mounting arrangement in accordance with a second embodiment of the invention where three engagement dowels 22*b*, forming an outer group 36, are arranged in the proximity of each side edge 31, 32 of the vane 14. The engagement dowels 22*b* are arranged adjacent each other in a row in the cross machine direction. Here too, the inner area 35 of the upstream end portion 21 of the vane extending between the two outer groups 36 is free from engagement dowels so that the inner area 35 of the vane 14, as well as the area downstream of this, are arranged to be able to move freely in the machine direction in relation to the downstream support wall 25. The retaining forces $F_r$ and the shearing forces $F_s$ together create a bending moment $M_b$ as shown in FIG. 10. The bending moment $M_b$ bends the vane 14 in its plane, stretches the downstream edge 30 of the vane 14 and generates tensile stresses $S_d$ in the cross machine direction in the downstream end portion 33 of the vane 14. The displacement arises under the same circumstances as those described for the vane in accordance with FIG. 7.

Figure 11:
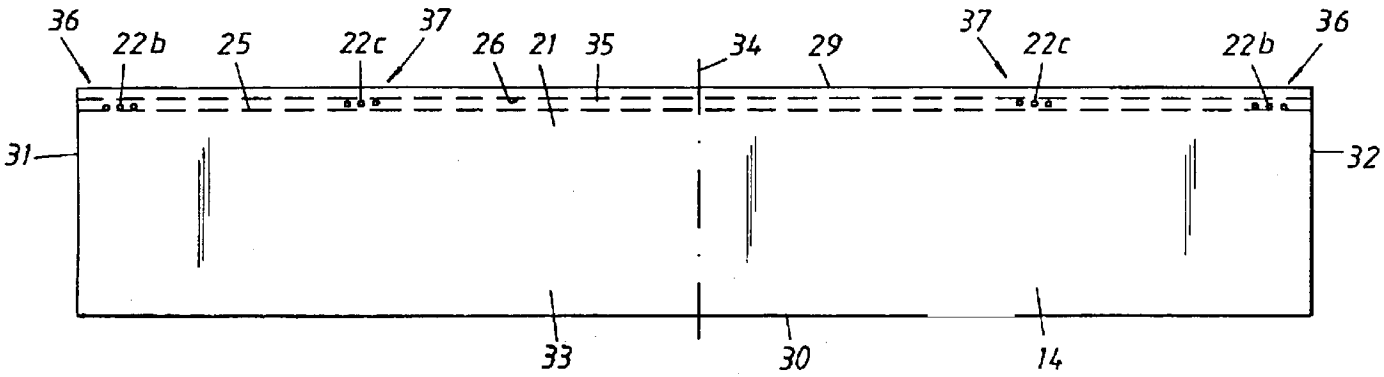
FIG. 11 is a view from above of an unloaded vane and shows parts of a mounting arrangement in accordance with a third embodiment of the invention.
Figure 12:
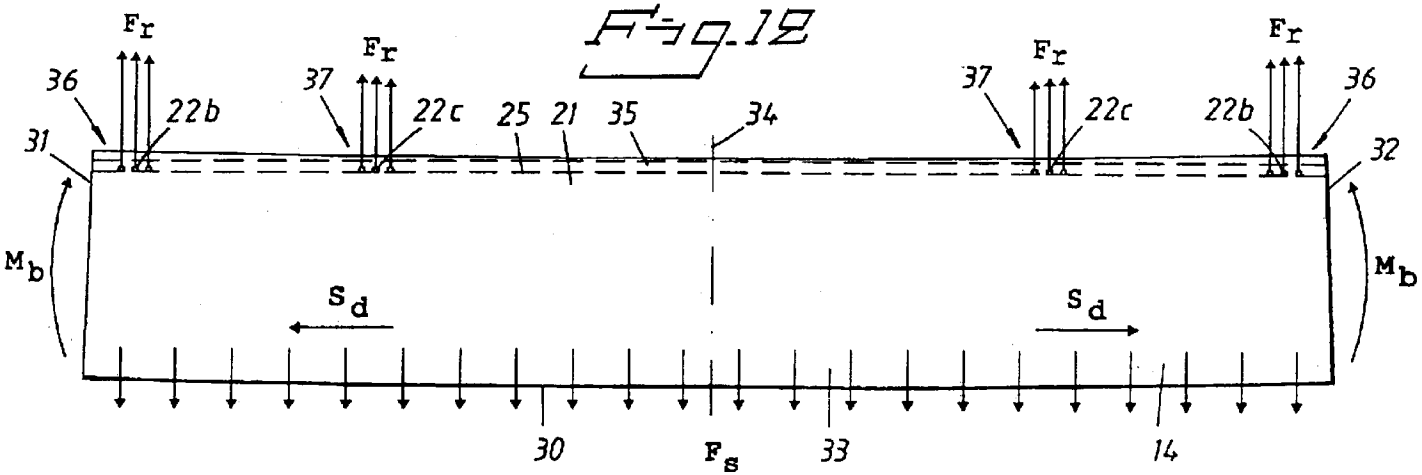
FIG. 12 is a view from above of the vane in accordance with FIG. 11 during operation.

FIG. 11 shows an unloaded vane 14 with parts of a mounting arrangement in accordance with a third embodiment of the invention, which is more suitable for high stock-flow velocities than the embodiments described previously. The vane 14 is provided with engagement dowels 22*b*, arranged in outer groups 36, as in the second embodiment described in connection with FIGS. 9 and 10, as well as engagement dowels 22*c* arranged in two inner groups 37 with three engagement dowels 22*c* in each group 37. The inner groups 37 of engagement dowels 22*c* are arranged at a predetermined distance from the outer groups 36. Each inner group 37 of engagement dowels 22*c* is arranged at a predetermined distance from the downstream support wall 25, e.g. about 5 mm. The distance to the outer group 36 of engagement dowels 22*b* can then be about 2000 mm. A first period of time commences with the stocks starting to flow through the headbox and finishes, e.g., when the inner groups 37 of engagement dowels 22*c* come into contact with the downstream support wall 25 in which the inner area 35 has been displaced in the machine direction under the influence of the shearing forces $F_s$ from the stocks, whereupon the downstream edge 30 of the vane 14 is stretched and a tensile stress $S_d$ in the cross machine direction is built up in the downstream end portion 33 of the vane 14. At the end of the period of time the machine speed has a predetermined value. It will thus be understood that the position of each inner group 37 of engagement dowels 22*c* in relation to the downstream support wall 25 and to the outer group 36 of engagement dowels 22*b* is decisive for each stock flow rate. During a second period of time, extending up to a moment when an increased machine speed has been set, the inner part-area 35*a*, defined by the inner groups 37 of engagement dowels 22*c*, moves forwards in the machine direction, the movement being limited by the displaced position when there is a risk of compressive stresses appearing in the downstream end portion 33 of the vane 14. When the vane consists of a plastic material and is narrowing, the swelling phenomenon must also be taken into account in choosing maximum stock flow rate or machine speed and determining the positions of the inner groups 37 of engagement dowels 22*c*. Instead of increasing the machine speed from the existing value when the inner groups 37 of engagement dowels 22*c* are in contact with the downstream support wall 25, the tensile stress that still exists in the downstream end portion 33 of the vane can be utilized to compensate the compressive stresses deriving from the swelling.

In a vane 14 consisting of plastic material and having a length of 800 mm, a width of 5500 mm, a thickness of the upstream end portion 21 of 4 mm, a thickness of the downstream end portion 33 of 0.5 mm, and which is intended to be subjected to a maximum stock flow rate of 2000 m/min, for instance, a suitable distance between two adjacent outer and inner groups 36, 37 may be about 2000 mm. In this case the inner groups 37 of engagement dowels 22*c* may be situated about 5 mm from the downstream support wall 25, seen in unloaded state of the vane 14. The engagement dowels in each group 36, 37 are preferably placed about 50 mm from each other. It is preferable to arrange the engagement dowels 22*b* and 22*c* within each group 36, 37 so that the distance to the downstream support wall 25 increases in two adjacent engagement dowels in the direction from the closest side edge 31, 32, respectively, of the vane 14. A suitable increase in this distance is about 0.1 mm.

It will be understood that the invention is not limited to three engagement dowels 22 in each group. More or fewer, e.g., two or four engagement dowels 22, may be used in each group. Neither is the invention limited to two inner groups 37 of engagement dowels 22. It is thus possible, for instance, to place additional inner groups of engagement dowels 22, spaced from the support wall 25, between the outer and inner groups 36, 37.

Figure 13:
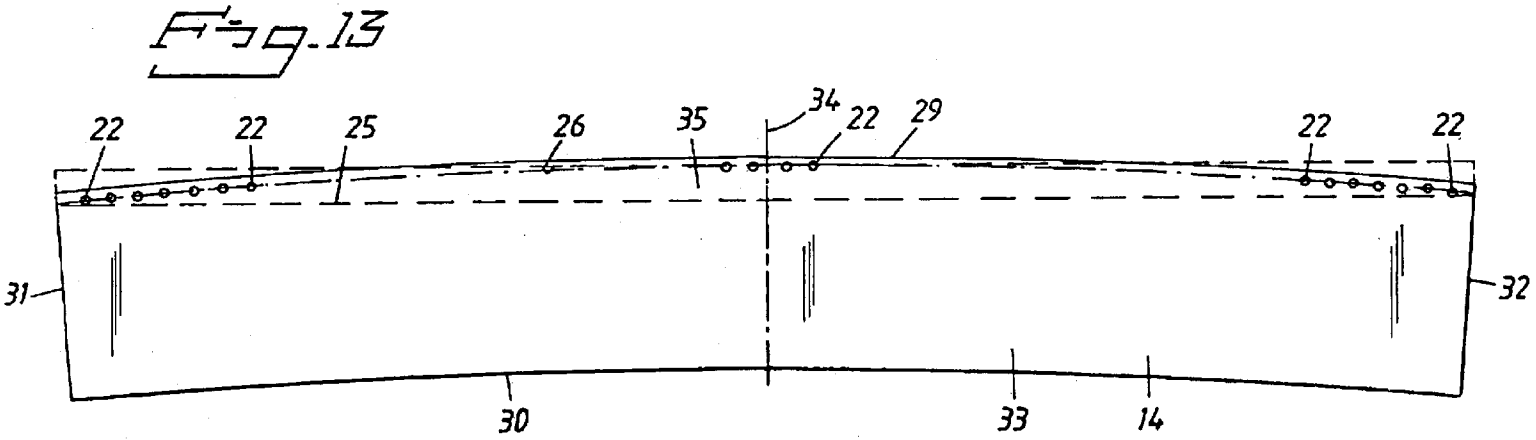
FIG. 13 is a view from above of an unloaded vane and shows parts of a mounting arrangement in accordance with a fourth embodiment of the invention.
Figure 14:
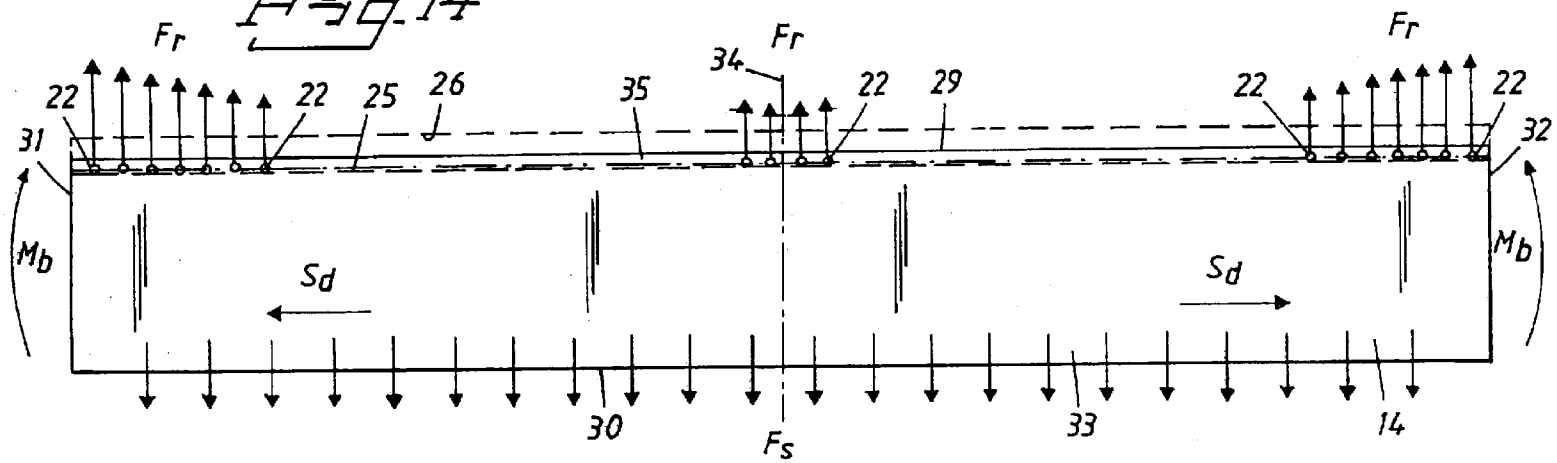
FIG. 14 is a view from above of the vane in accordance with FIG. 13 during operation.

FIG. 13 shows an unloaded vane 14 with parts of a mounting arrangement in accordance with a fourth embodiment of the invention, the engagement dowels 22 being arranged in a row along a curved line extending between the side edges 31, 32 and symmetrical about the center line 34. In the embodiment shown the engagement dowels 22 are arranged with uniform spacing but in accordance with an alternative embodiment (not shown) the spaces may be different and distributed in a regular pattern, e.g., groups of engagement dowels with equal distance between them within the group and equal but greater distance between the groups. In the embodiment shown in FIG. 13 a certain number, e.g. 3–5, of the engagement dowels situated nearest a side edge 31, 32 may be considered to be included in an outer group of engagement dowels, whereas the other engagement dowels may be considered to constitute separate inner engagement dowels situated one after the other, or to form inner groups of engagement dowels, depending on the shape of the curved line and the distance between the engagement dowels as mentioned above. If the highest machine speed is to be used immediately for such a vane, a period of time commences at the moment when the stocks start flowing through the headbox and extends to the moment when the engagement dowels 22 closest to the center line 34 also come into contact with the downstream support wall 25 as a result of the influence of the shearing forces $F_s$ from the stocks, whereupon the downstream edge 30 is stretched and a tensile force $S_d$ in the cross machine direction is built up in the downstream end portion during this period of time, as illustrated in FIG. 14. If the vane consists of a plastic material, is narrowing and can no longer be moved forwards within the central area, there may be such a large excess of tensile stress in the downstream end portion at the end of the period of time that remaining swelling gives compressive stresses that are balanced by the excess of tensile stress. If the tensile stress decreases to zero and the vane is still not saturated, i.e., the swelling is going on, the maximum machine speed must be reduced in a corresponding degree. It will be understood that periods of time shorter than that described exist that thus terminate at a moment when a lower machine speed than the maximum is set and corresponds to a specific displacement of the inner area so that at least two inner engagement dowels or two inner groups of engagement dowels situated at a distance from the center line 34 of the vane, are in contact with the downstream support wall 25.

In the vane shown in FIG. 13 the engagement dowels are arranged in a row along a curved line that, when the vane is unloaded, has a certain extension in the machine direction. By mounting such a vane in a connection bar where the distance between the previously mentioned support walls is less than the extension of the curved line in the machine direction, tensile stresses in the downstream end portion of the vane can be provided already when the vane is mounted in the groove of the connection bar. Through the narrow groove recess, in relation to the curved line, forming the support walls, the outer engagement dowels situated closest to the side edges of the vane will be caused, upon insertion of the vane into the groove, to cooperate with the support wall situated downstream of the groove and will absorb support forces therefrom. In corresponding manner, the inner engagement dowels situated nearest the center line of the vane will cooperate with the support wall situated upstream of the groove and will absorb support forces therefrom. In the same way as the above-mentioned shearing and retaining forces, the support forces will bend the vane in its plane, stretch the downstream edge of the vane and generate tensile stresses in the cross machine direction in the downstream end portion of the vane. These tensile stresses ensure that the vane is flat right at the start-up phase of the headbox, i.e., before the stocks have had time to influence the vane.

To make sure that the downstream edge of the vane is straight or substantially straight at a certain machine speed, e.g., maximum speed (without compressive stresses arising), this downstream edge may be pre-shaped to an extent equivalent to the displacement the vane is able to perform until the flows of stock act with a constant shearing force at the machine speed and/or the vane is completely saturated, when this consists of a plastic material and has narrowing thickness. FIGS. 13 and 14 illustrate a vane having such a pre-shaped concave downstream edge 30 with the same curvature as the curved line along that the engagement dowels 22 are arranged. The concave downstream edge 30 is then stretched to straight form upon the loading of the vane. The side edges 31, 32 have also been pre-shaped to incline in relation to the center line 34.

In accordance with an alternative embodiment (not shown) the inner engagement dowels are arranged along a straight line in which the outer engagement dowels or the outer groups of engagement dowels are situated, in which case the downstream support wall is designed with small recesses or with sections of larger recesses or with a predetermined concave shape, e.g., circular arc-shaped, thereby enabling free displacement of the vane even in this mirror-image relationship. It is also possible to give the downstream end wall a concave shape with a predetermined first radius, and arrange the engagement dowels along a curved line with a predetermined second radius that is larger than the first radius.

According to the invention buckling of the vane 14 is avoided by arranging one or more engagement dowels 22 in the proximity of the side edges 31, 32 of the vane 14 in order, as substantially the only engagement dowels 22 and at least during a limited period of time, to cooperate with the support wall 25 situated downstream in order to take up the shearing forces, while at the same time the inner area 35 of the upstream end portion 21 of the vane 14 can move freely, i.e., without influence from outer retaining forces from engagement dowels, in the machine direction in relation to the downstream support wall 25 during the period of time or part thereof. By arranging the engagement dowels 22 in the manner described above they create, during operation, shearing forces $F_s$ acting on the vane 14, together with the retaining forces $F_r$ acting on the engagement dowels 22 a bending moment $M_b$, which under normal operating conditions always bends the vane 14 in its plane and generates tensile stresses $S_d$ in the cross machine direction in the downstream end portion 33 of the vane 14. The placing of the engagement dowels 22 in accordance with the principle of the invention prevents that the compressive stresses described previously will arise in the downstream end portion 33 of the vane 14. A characteristic feature of the invention is thus that compressive stresses are prevented in the vane, which compressive stresses may cause the vane to buckle so that the stock layering may be affected in an unfavorable manner.

The invention has been described above in connection with engagement members in the form of engagement dowels 22. However, it will be understood that the invention can be realized with other types of engagement members. Besides the engagement members being designed as a plurality of discrete elements such as engagement dowels, they may consist of a continuous engagement element cooperating with the downstream support wall in accordance with the principles of the invention.

It will also be understood that the invention can be realized using other mounting arrangements than those described above. The vane 14 may be attached directly to the anchoring element 10, for instance, which then has the same function as the elongate connection bar 16 and has a groove with support walls similar to that in the connection bar.

Many modifications and other embodiments of the inventions set forth herein will come to mind to one skilled in the art to that these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A headbox for delivering a jet of stock to a forming zone in a former for wet forming of a fiber web, comprising:

a slice having a chamber;

a turbulence generator comprising turbulence channels opening into the slice chamber, and at least one anchoring element that separates the turbulence channels, at least one vane arranged in the slice chamber; and an arrangement for detachable mounting of the vane to said anchoring element, said mounting arrangement comprising a plurality of engagement members that are connected to the vane at an upstream end portion thereof, and an elongate structural element having a longitudinal groove for receiving the engagement members of the vane, said groove having inner, parallel, downstream and upstream support walls that face towards said engagement members for cooperation therewith, wherein said plurality of engagement members comprise at least one outer engagement member in the proximity of each side edge of the vane such that an inner area of the upstream end portion of the vane is defined between said outer engagement members, said outer engagement members being arranged during operation for at least one specific period of time as the only engagement members to contact the downstream support wall, such that said inner area of the upstream end portion is arranged to move freely in the machine direction in relation to said downstream support wall during said period of time or part thereof.

2. The headbox as claimed in claim 1, wherein each outer engagement member comprises a plurality of engagement elements.

3. The headbox as claimed in claim 1, wherein said inner area of the upstream end portion has inner engagement members that, at least in an unloaded state of the vane, are located upstream of said downstream support wall.

4. The headbox as claimed in claim 3, wherein said inner engagement members form at least two inner groups arranged at a predetermined distance from the outer engagement members, each inner engagement member being arranged at a predetermined distance from the downstream support wall.

5. The headbox as claimed in claim 4, wherein said distance from the inner engagement members to the downstream support wall increases for two adjacent engagement members within each group in a direction from the side edge of the vane.

6. The headbox as claimed in claim 5, wherein said distance from the inner engagement members to the downstream support wall increases by about 0.1 mm between two adjacent engagement members within each group.

7. The headbox as claimed in claim 1, wherein the engagement members are arranged along a curved line extending between the side edges and are spaced with uniform or non-uniform spacing.

8. The headbox as claimed in claim 1, wherein in an unloaded state the vane has a pre-shaped concave downstream edge that is stretched during operation to substantially straight form through said displacement of the vane in relation to the outer engagement members.

9. The headbox as claimed in claim 1, wherein even at the end of said period of time the vane is free from compressive stresses.

10. The headbox as claimed in claim 1, wherein said structural element comprises a connection bar with an engagement part defining said groove, a flexible waist part, and an engagement part for mounting in a groove of said anchoring element.

11. An arrangement for detachably mounting a vane to an anchoring element of a turbulence generator of a headbox for delivering a jet of stock to a forming zone in a former for wet forming a fiber web, the headbox comprising a slice having a chamber, said turbulence generator comprising turbulence channels opening into the slice chamber, and said anchoring element that separates the turbulence channels, at least one vane arranged in the slice chamber, said mounting arrangement comprising:

a plurality of engagement members connected to the vane at its upstream end portion, and an elongate structural element having a longitudinal groove for receiving the engagement members of the vane, said groove having inner, parallel, downstream and upstream support walls that face towards said engagement members for cooperation therewith, wherein said plurality of engagement members comprise at least one outer engagement member in the proximity of each side edge of the vane such that an inner area of the upstream end portion of the vane is defined between said outer engagement members, said outer engagement members being arranged during operation for at least one specific period of time as the only engagement members to contact the downstream support wall such that said inner area of the upstream end portion is arranged to move freely in the machine direction in relation to said downstream support wall during said period of time or part thereof.

12. The arrangement as claimed in claim 11, wherein each outer engagement member comprises a plurality of engagement elements.

13. The arrangement as claimed in claim 11, wherein said inner area of the upstream end portion has inner engagement members that, at least in an unloaded state of the vane, are located upstream of said downstream support wall.

14. The arrangement as claimed in claim 13, wherein said inner engagement members form at least two inner groups arranged at a predetermined distance from the outer engagement members, each inner engagement member being arranged at a predetermined distance from the downstream support wall.

15. The arrangement as claimed in claim 14, wherein said distance from the inner engagement members to the downstream support wall increases for two adjacent engagement members within each group in a direction from the side edge of the vane.

16. The arrangement as claimed in claim 15, wherein said distance from the inner engagement members to the downstream support wall increases by about 0.1 mm between two adjacent engagement members within each group.

17. The arrangement as claimed in claim 11, wherein the engagement members are arranged along a curved line extending between the side edges and are spaced apart with uniform or non-uniform spacing.

18. The arrangement as claimed in claim 11, wherein in an unloaded state the vane has a pre-shaped concave downstream edge that is stretched during operation to substantially straight form through said displacement of the vane in relation to the outer engagement members.

19. The arrangement as claimed in claim 11, wherein even at the end of said period of time the vane is free from compressive stresses.

20. The arrangement as claimed in claim 11, wherein said structural element comprises a connection bar with an engagement part defining said groove, a flexible waist part, and an engagement part for mounting in a groove of said anchoring element.

* * * * *